United States Patent [19]
Bell
[11] 4,425,848
[45] Jan. 17, 1984

[54] FLEXOGRAPHIC INK DISTRIBUTION SYSTEM

[76] Inventor: Clinton C. Bell, 4925 Torrey Pines Ct., Charlotte, N.C. 28211

[21] Appl. No.: 392,651

[22] Filed: Jun. 28, 1982

Related U.S. Application Data

[62] Division of Ser. No. 266,890, May 26, 1981.

[51] Int. Cl.³ ..... B41F 31/04; B41F 31/06; B41F 31/36

[52] U.S. Cl. ..... 101/350; 101/169

[58] Field of Search ..... 101/363, 364, 350, 351, 101/352, 366, 348, 349, 206, 207, 208, 210, 148, 157, 169; 118/262, 263, 258, 259, 413, 414, DIG. 20, DIG. 15, 249, 117

[56] References Cited

U.S. PATENT DOCUMENTS

| | | | |
|---|---|---|---|
| 2,560,572 | 7/1951 | Haywood et al. | 118/262 X |
| 2,729,192 | 1/1956 | Warner | 118/117 |
| 2,922,364 | 1/1960 | Nitchie et al. | 101/364 |
| 2,970,564 | 2/1961 | Warner | 118/249 |
| 3,486,482 | 12/1969 | Hunger | 118/413 X |
| 3,559,572 | 2/1971 | Hackley | 101/350 |
| 3,621,779 | 11/1971 | Carl et al. | 101/366 |
| 3,899,999 | 8/1975 | Christ | 101/366 |
| 3,901,150 | 8/1975 | Kirby, Jr. | 101/363 |
| 4,009,657 | 3/1977 | Bonanno et al. | 101/366 X |
| 4,211,167 | 7/1980 | Corse | 101/363 |
| 4,284,005 | 8/1981 | Weigele et al. | 101/363 |
| 4,316,428 | 2/1982 | Flaum et al. | 118/261 X |

*Primary Examiner*—J. Reed Fisher
*Attorney, Agent, or Firm*—Woodard, Weikart, Emhardt & Naughton

[57] ABSTRACT

A system for applying and then removing ink in a metering fashion from a roll. A wire wound rod is rotated in a direction opposite of an ink applicator roll with the rod and roll in contact together. Ink is applied uniformly across the outer surface of the applicator roll with a portion of the ink then being removed from the applicator roll by the wire wound rod. The ink remaining on the applicator roll is then transferred to a printing plate provided on a roll rotatably mounted adjacent to the applicator roll. Spring biased washer seals mounted to the metering rod engage the opposite ends of the applicator roll and the metering rod mounting block limiting ink flow therefrom. Ink drainage channels in the metering rod mounting block drain the ink therefrom into a receptacle connected by conduits to a reservoir and pump operable to direct ink back onto the roll. An inflatable pressurized container is operable to move the metering rod to and from the applicator roll.

7 Claims, 9 Drawing Figures

FLEXOGRAPHIC INK DISTRIBUTION SYSTEM

This application is a division of application Ser. No. 266,890, filed May 26, 1981.

BACKGROUND OF THE INVENTION

This invention is in the field of printing and more specifically systems for applying ink to an applicator roll in a metering fashion. In flexographic printing, the board to be printed is passed between a rotating plate cylinder and an impression roll. The plate cylinder has mounted thereon a printing plate contactable with a third roller applying ink to the plate once per revolution of the plate cylinder. Fresh ink is continuously applied to the applicator roll with some type of device used to remove excess ink from the outer surface.

The prior applicator rolls are metal with a finely engraved outer surface provided to hold the ink upon the surface of the roll. The printing plate contacting the applicator roll is produced from rubber or photopolymer material resulting in a rapid deterioration of the printing surface. Eventually, the applicator roll which is very large and heavy must be removed from the printer and shipped back to a repair facility. The removal of the roll requires complete shutdown of the printer for several days. Once the applicator roll arrives at the repair facility, it is machined down, in certain cases recoated with metal and then engraved. The engraved surface may be as coarse as seven cells per lineal inch or a fine as five hundred cells per lineal inch. The cell is either in an inverted pyramid shape configuration with an outer square opening and a pointed base or as a quad cell configuration having an outer square opening but a reduced square base and slightly inclined walls. In either event reworking of the applicator roll is quite expensive and requires a large amount of time to repair and reinstall in the printer.

It is the practice to remove the ink from the engraved applicator rolls once contacted by the printing plate by either a rubber wiper roll contacting the applicator roll or an air activated doctoring or meter blade. An expandable air tube or a series of air cylinders mounted adjacent the blade moves the blade to and from the applicator roll to remove the excess ink from the roll. The use of the rubber wiper roll with a cellular applicator roll provides an alternative method for removing excess ink from the surface of the applicator roll. Further, as the engraved applicator roll is used ink buildup along with dirt will accumulate on the roll requiring frequent cleaning of the applicator roll. Another disadvantage of the cellular applicator roll is the requirement of even ink distribution across the applicator roll to prevent the roll from burning during operation.

Disclosed herein is a printer having a rubber applicator roll with a smooth outer surface. A rod having a wire wound or similarly contoured surface is used in conjunction with a device applying ink to the applicator roll for the purpose of finely metering and removing excess ink from the applicator roll prior to ink transfer to the printing plate. The wire wound rod is small and lightweight allowing for very simple and quick removal from the printer for the purpose of installation of a new rod having a different metering capability depending upon the size of the wire wrapped thereon. The rubber applicator roll does not wear nearly as fast as the metallic cellular applicator roll. The necessity for refinishing of the applicator roll as previously described is completely eliminated. Superior printing results are achieved since the ink may be metered on the applicator roll through the use of different wire wound rods depending upon the type of printing required. For example, heavy or large lettering requires a large amount of ink on the applicator roll and thus a metering rod having a large wire wrapped thereon is utilized as compared to fine small printing in which case a metering rod having a fine wire wrapped thereon is utilized. Previously, the metallic cellular applicator roll having a fixed configuration was used for all printing including fine and large printing due to the large amount of time and effort required for the removal of the applicator roll. Thus the prior applicator rolls would be chosen to apply an average amount of ink somewhere between what was actually required for fine printing and heavy printing. The results using such an applicator roll are unsatisfactory.

The metering rod and rubber roll system disclosed herein are designed to be included as original equipment or installed into existing printers in the form of a kit. The cost of such a system is significantly lower as compared to the cellular applicator roll.

Grooved rollers have previously been used for a variety of tasks. For example, U.S. Pat. No. 3,718,117, issued to Lewicki, Jr. discloses a grooved rod used to apply a uniform coating of particulate containing material. A similar device is disclosed in U.S. Pat. No. 3,312,191, issued to Lowe. Likewise, a grooved roller for use in a rotary printing press is disclosed in U.S. Pat. No. 3,098,437, issued to Tyma, Jr., et al. whereas U.S. Pat. No. 3,613,575, issued to Kantor discloses a grooved oscillator roll for use in a printing press to achieve break up and distribution of the substances with which it comes into contact.

SUMMARY OF THE INVENTION

One embodiment of the present invention is a system for applying and then removing in metering fashion ink from a roll comprising first means including ink and having an outlet adjacent the roll operable to apply ink to the roll; and second means operable to meter and remove excess ink from the roll and including a member with an outer surface with parallel ridges thereon separated by grooves to receive ink from the roll as the ridges contact the roll and meter ink therefrom.

Another embodiment of the present invention is a device for removing a liquid like substance from a roll comprising a rod mounted adjacent the roll and extending the length thereof, the rod including a grooved outer surface with ridges thereon in contact with the roll, said grooves are separated by the ridges and are arranged to limit flow of the substance in one groove to another groove at the location of contact with the roll.

It is an object of the present invention to replace the engraved and random cell ink transfer roller utilized in flexographic printers with a soft resilent roller.

A further object of the present invention is to transfer ink to a printing plate from a soft resilent roller.

Yet another object of the present invention is to meter ink from a soft resilent roller by means of a metering system leaving only the correct amount of ink on the transfer roller and depending upon the type of printing to be accomplished.

DESCRIPTION OF THE PREFERRED EMBODIMENT

Figure 1:
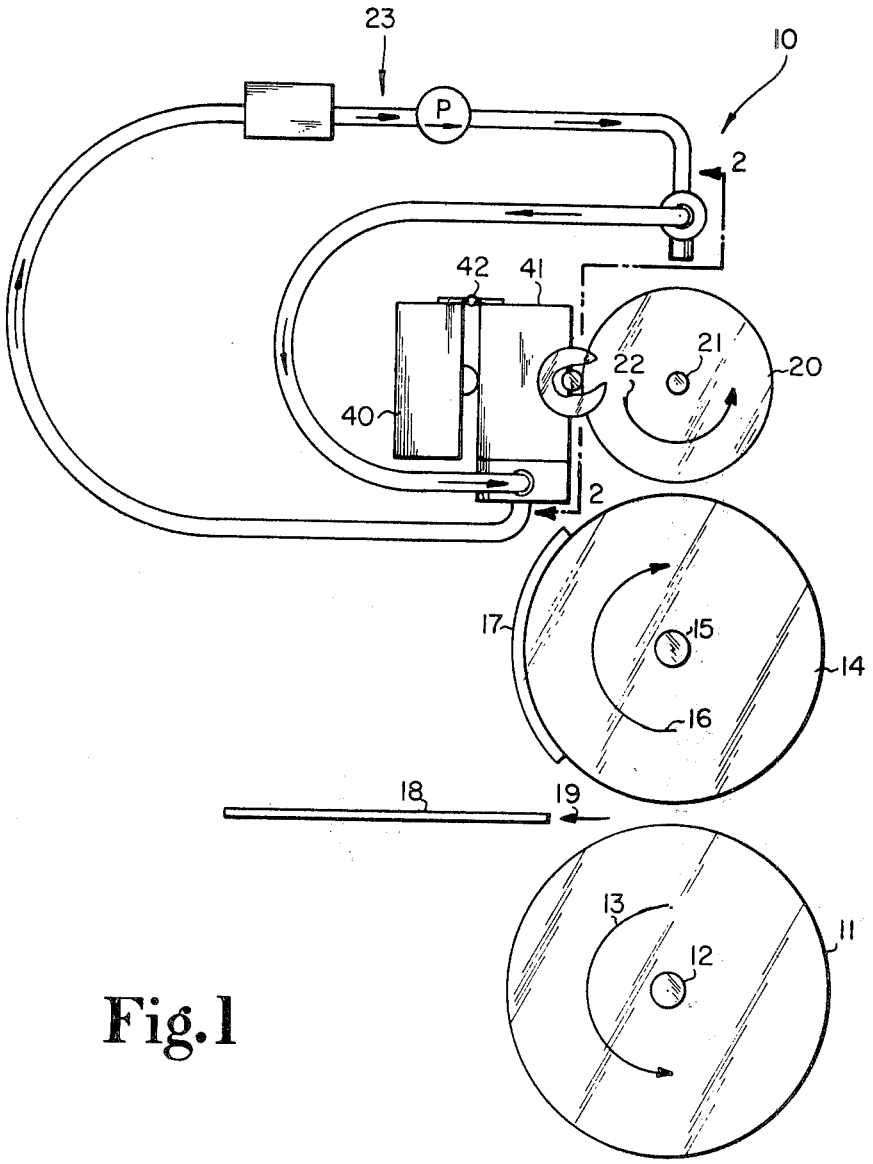
FIG. 1 is a end view of a printer incorporating the resilent applicator roll and metering rod system.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to FIG. 1, there is shown a printer 10 having a cylindrical impression roll 11 rotatably mounted on axle 12 to move in the direction of arrow 13. Printer 10 further includes a plate cylinder 14 rotatably mounted on axle 15 to move in the direction of arrow 16 and having mounted thereon a printing plate 17 with the required indicia to print upon board 18. Plate 17 is spaced apart from the outer surface of impression roller 11 a sufficient distance to allow board 18 to pass in the direction of arrow 19 between the cylinder and roll while being impressed thereon the indicia upon plate 17.

A resilent applicator roll 20 is rotatably mounted to axle 21 and is rotated in the direction of arrow 22 past the ink distribution system 23 applying and metering ink upon roll 20 prior to the roll contacting plate 17. Plate 17 is spaced a sufficient distance from applicator roll 20 to contact the applicator roll once per revolution of plate cylinder 14.

Ink distribution system 23 (FIG. 2) includes first means 24 for applying ink to applicator roll 20. The first means 24 has a main body 25 with a hollow interior in communication via a main ink inlet 26 with a reservoir 27 of ink. A conventional pump 28 is disposed between and connected by conduits 29 and 30 to the reservoir 27 and main ink inlet 26. The ink flows through inlet 26 into main body 25 and exits the main body by a main ink outlet 31 and a plurality of downwardly extending outlets 32 opening over and adjacent roll 20. The outlets 32 are spaced along the length of roll 20 to achieve an even distribution of the ink on the applicator roll.

Figure 5:
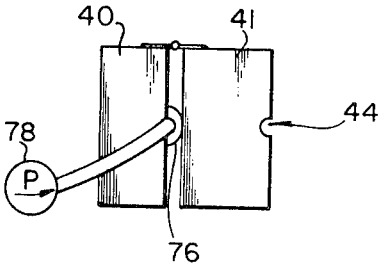
FIG. 5 is an end view looking in the direction of arrows 5—5 of FIG. 4 of the metering rod holder.

Block 40 is fixedly mounted to the frame supporting the three rolls with a second block 41 hingedly mounted to block 40 by means of a conventional hinge or fastener 42. Metering rod 43 is rotatably mounted to block 41 being received within a semi-circular channel 44 (FIG. 5). End 45 of rod 43 is bearingly received and mounted by bearing block 46 with the opposite end of rod 43 having a hexagonally shaped configuration and being removably received by socket 47 of block 48 in turn fixedly secured to a conventional gear 58 mounted to bearing block 49 by axle 50. Gear 58 is in meshing engagement with gear 51 rotatably driven by conventional motor 52. Suitable means is provided for the mounting of block 48 to facilitate the removal of rod 43, such as, spring biasing block 48 and axle 50 in position. A pair of dish shaped washers 53 and 54 are mounted to rod 43 and are urged against the opposite ends of block 41 and applicator roll 20 to prevent or to limit the flow of ink outwardly from the opposite ends of block 41. A pair of helical springs 55 are mounted to rod 43 and urge seals 53 and 54 against the opposite ends of the applicator roll.

Figure 7:
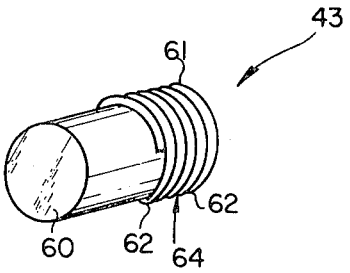
FIG. 7 is a fragmentary perspective view of a portion of the wire wound metering rod.

A fragmentary perspective view of the metering rod 43 is shown in FIG. 7. Metering rod 43 has a main cylindrical body 60 with a wire 61 helically wound along the length of main body 60 forming a plurality of ridges 62 between which are located grooves 64. Each wire has a cylindrical cross-section providing a curved outer surface for contacting the rubber applicator roll. Such a wire wound metering rod may be purchased from RK Print-Coat Instruments Ltd., Southview Laboratories, Litlington, Royceton Hoyston, Herts. The rods sold by RK Print-Coat Instruments Ltd. are for the purpose of manually applying all types of materials including inks to a surface for testing under very exact conditions. The rod has heretofore not been used in a printer for metering ink on an applicator roll. The wire wrapped on the metering rod is available in diameters from 0.002 to 0.060 inches. The outside diameter of the metering rod is less than one-half inch and is therefore less than one-tenth of the outside diameter of the applicator roll. A single wire is helically wound on the metering rod; however, the same results will be obtained by winding multiple wires in side by side fashion on the rod. The grooves between the adjacent coils of the wire provide a channel for metering away the unwanted ink upon the applicator roll. As such, the wire coils are arranged to limit flow of ink from one groove to another groove at the location of contact with the applicator roll. Best results have been obtained in rotating the metering rod in a direction opposite the direction of rotation of roll 20. One of the washer seals shown in FIG. 1 is fragmented to clearly illustrate the metering rod contacting the outer surface of the rotating applicator roll 20.

Figure 2:
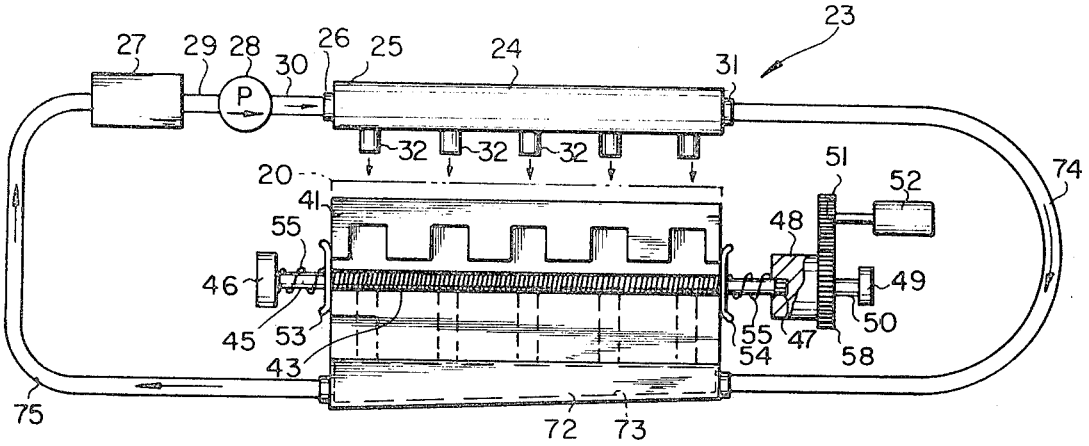
FIG. 2 is a cross-sectional view taken along the line 2—2 of FIG. 1 and viewed in the direction of the arrows.
Figure 3:
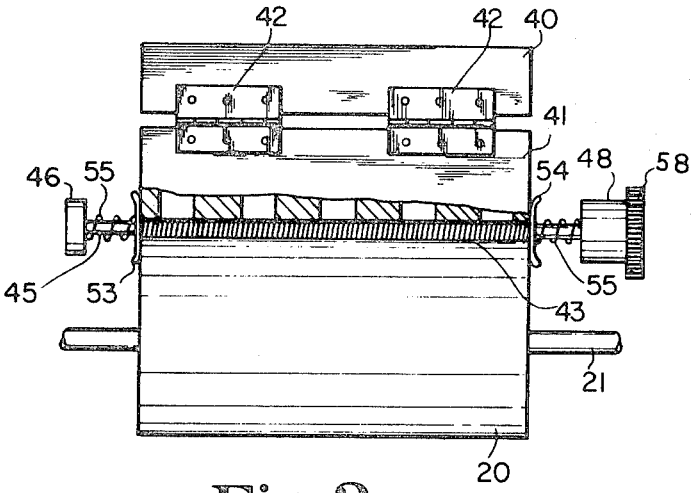
FIG. 3 is a fragmentary top view of the metering rod and holder shown in FIG. 2.
Figure 4:
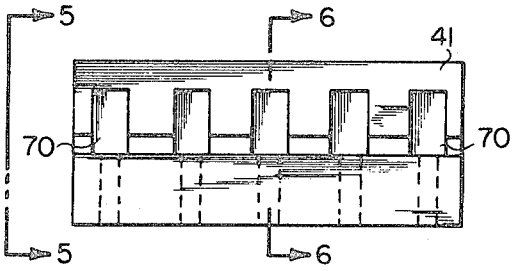
FIG. 4 is the same view as FIG. 2 of the metering rod holder.
Figure 6:
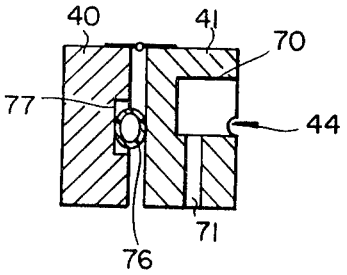
FIG. 6 is a cross-sectional view taken along the lines 6—6 of FIG. 4 and viewed in the direction of the arrows.

A plurality of cut out portions or reliefs 70 are provided in mounting block 41 and are positioned along the lengths thereof corresponding to the locations of the downwardly extending outlets 32. Thus, as metering rod 43 contacts the applicator roll the excess ink on the roll will be metered or taken from the roll flowing through the grooves 64 (FIG. 6) of the metering rod and into reliefs 70 in turn leading to a plurality of downwardly extending channels 71 emptying into a receptacle 72 (FIG. 2). Receptacle 72 has a hollow interior with a downwardly sloping bottom wall 73. The wall slopes downwardly as viewed in FIG. 2 from right to left. A conduit 74 is connected to the main ink outlet 71 of ink dispenser 24 with the opposite end of conduit 74 connected to receptacle 73 allowing ink to be flushed through the receptacle for cleaning purposes. A second conduit 75 leads from the outlet of receptacle 73 back to reservoir 27 with pump 28 providing sufficient force to circulate the ink. The ink then passes onto the metering rod and through the receptacle back to reservoir 27.

A conventional expandable pressurized container or air bag 76 (FIG. 5) is mounted within cavity 77 of block 40 and is connected to a source of pressure 78. Source 78 applies pressure to container 76 forcing the container to expand and causing block 41 and metering rod 43 to pivot with rod 43 contacting the applicator roll. Release of pressure by the source allows deflation of the pressurized container allowing the metering rod to swing back from the applicator roll. In the event that a large amount of ink is to be removed from the applicator roll, then a metering rod with a relatively small diametered wire wound on the metering rod is utilized whereas if a small amount of ink is to be removed from the applicator roll then a metering rod is utilized having a relatively large diametered wire wound thereon.

Many variations are contemplated and included in the present invention. Best results have been obtained by rotating the metering rod at approximately thirty revolutions per minute; however other speeds are satisfactory. Further, the applicator roll should be produced from a non-metallic elastic material such as rubber or suitable plastic. The metering rod may be utilized in devices other than printers such as for metering adhesives on a roll. An additional roller running parallel to and in contact with applicator roll 20 may be employed when necessary to smooth out the ink on the applicator roll and eliminate any undesirable accumulations of ink on the applicator roll.

Figure 8:
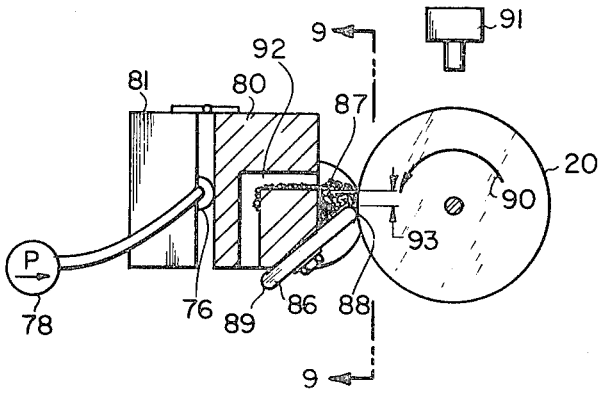
FIG. 8 is a fragmentary side view of an alternate embodiment of the metering device and holder.
Figure 9:
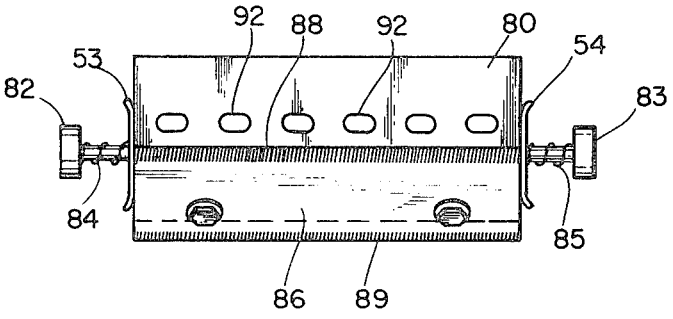
FIG. 9 is a cross sectional view taken along the line 9—9 of FIG. 8 and viewed in the direction of the arrows.

FIGS. 8 and 9 show an alternate embodiment of the present invention identical to that previously described except the rotating metering rod is replaced with a stationary metering plate and the ink flow removal channels in the holder are different in configuration. Thus, holder 80 is hingedly mounted to block 81 and is movable to and from the applicator roll 20 by means of air bag 76 connected to a source of pressure 78. A pair of dish shaped washers or seals 53 and 54 are mounted by headed rods 82 and 83 secured to block 80 and urged against the opposite ends of block 80 and roll 20 by springs 84 and 85.

A plate 86 is bolted to the bottom of block 80 and forms a V-shaped ink reservoir 87 with block 80. The top edge 88 and bottom edge 89 of plate 86 are provided with a plurality of parallel ridges separated by grooves extending in the direction of rotation of roll 20 shown by arrow 90. As roll 20 rotates past the ink supply 91, ink is deposited atop roll 20 with roll 20 then rotating past and in contact with the top edge 88 of plate 86 which removes in metering fashion excess ink from the roll prior to the roll contacting the printing plate or an adjacent roll. The ink removed by plate 86 accumulates in the V-shaped reservoir 87 and then flows out passages 92 to receptacle 72 (FIG. 2) and recirculates to supply 91. Passages 92 are located approximately 1/32 inches above top edge 88 shown by dimension 93 allowing the ink to flow evenly across roll 20 at the location of contact with top edge 88. The grooves and ridges on bottom edge 89 are of different size than those on top edge 88 allowing for reversal of the plate facilitating different metering of the ink from roll 20.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A system for applying and then removing in metering fashion ink from a roll comprising:

first means including ink and having an outlet adjacent said roll operable to apply ink to said roll;

second means operable to meter and remove ink from said roll and including a member with an outer surface with parallel ridges thereon separated by grooves to receive ink from said roll as said ridges contact said roll and remove ink therefrom, said member is a plate with a first edge adjacent said roll and an opposite parallel edge, each edge having a series of said grooves formed thereon, said grooves on said first edge are sized differently from said grooves on said opposite edge, said plate is mounted adjacent said roll and is remountable thereon to locate said opposite edge in the position previously occupied by said first edge adjacent said roll depending on the amount of ink to be metered from said roll.

2. The system of claim 1 and further comprising:

third means connected to and between said first means and said second means to provide ink to said first means from said second means.

3. The system of claim 2 and further comprising fourth means in contact with said second means and operable to move said member to and from said roll.

4. The system of claim 1 wherein said first means includes a main body with a main ink inlet leading into a hollow interior of said main body and a plurality of downwardly extending outlets opening adjacent said roll and spaced along the length of said main body.

5. A system for applying and then removing in metering fashion ink from a roll comprising:

first means including ink operable to drip ink atop said roll;

second means spaced from said first means operable to meter and remove ink from said roll and including a member with an outer surface with parallel ridges thereon separated by grooves to receive ink from said roll at a location aside said roll as said ridges contact said roll and remove ink therefrom;

third means connected to and between said first means and said second means to provide ink to said first means from said second means;

fourth means in contact with said second means and operable to move said member to and from said roll; and wherein:

said first means includes a main body with a main ink inlet leading into a hollow interior of said main body and a plurality of downwardly extending outlets opening adjacent said roll and spaced along the length of said main body, said third means includes a reservoir of ink and pumping means connected thereto, said third means further includes conduit means connecting said main ink inlet, pumping means and second means together directing ink from said grooves into said hollow interior and minimizing collection of said ink at said location, said member is a plate with a first edge adjacent said roll and an opposite parallel edge with each edge having a series of said grooves formed thereon, said grooves on said first edge are sized differently from said grooves on said opposite edge, said plate is mounted adjacent said roll and is remountable thereon to locate said opposite edge in the position previously occupied by said first edge adjacent said roll depending on the amount of ink to be metered from said roll.

6. The system of claim 4 and further comprising mounting means connected to said second means and operable to allow movement thereof to and from said roll and further comprising fourth means and wherein said fourth means includes an inflatable pressurizable container positioned adjacent said second means and operable to move said second means and member to and from said roll.

7. The system of claim 1 and further comprising:

a frame mountingly receiving said plate and cooperatively forming therebetween a V-shaped ink reservoir with a top level above said first edge distributing ink across said roll.

* * * * *